US005678133A

United States Patent [19]

Siegel

[11] Patent Number: 5,678,133

[45] Date of Patent: Oct. 14, 1997

[54] AUTO-GLOSS SELECTION FEATURE FOR COLOR IMAGE OUTPUT TERMINALS (IOTS)

[75] Inventor: Robert P. Siegel, Penfield, N.Y.

[73] Assignee: Xerox Corporation, Stamford, Conn.

[21] Appl. No.: 673,530

[22] Filed: Jul. 1, 1996

[51] Int. Cl.[6] ..... G03G 15/01; G03G 15/20

[52] U.S. Cl. ..... 399/67; 219/216; 399/82; 399/321; 399/329; 430/124

[58] Field of Search ..... 355/208, 282, 355/285, 311, 326 R, 327, 204; 358/501, 296; 430/124; 399/67, 82, 321, 329, 331, 33; 219/216

[56] References Cited

U.S. PATENT DOCUMENTS

| | | | |
|---|---|---|---|
| 4,248,528 | 2/1981 | Sahay | 355/308 |
| 4,609,283 | 9/1986 | Murata et al. | 355/208 |
| 4,920,384 | 4/1990 | Okamoto | 355/311 |
| 4,937,592 | 6/1990 | Akao et al. | 346/134 |
| 5,049,929 | 9/1991 | Anderson et al. | 355/204 |
| 5,127,643 | 7/1992 | DeSanctis et al. | 271/9.05 |
| 5,155,536 | 10/1992 | Johnson et al. | 355/285 X |
| 5,319,426 | 6/1994 | Baruch et al. | 355/285 |
| 5,363,173 | 11/1994 | Alesio et al. | 355/204 |
| 5,502,555 | 3/1996 | Lakatos | 355/311 |

FOREIGN PATENT DOCUMENTS

| | | |
|---|---|---|
| 4-145766 | 5/1992 | Japan . |
| 5-333643 | 12/1993 | Japan . |
| 7-271230 | 10/1995 | Japan . |
| 7-311506 | 11/1995 | Japan . |

*Primary Examiner*—Arthur T. Grimley
*Assistant Examiner*—Sophia S. Chen
*Attorney, Agent, or Firm*—Kevin R. Kepner

[57] ABSTRACT

There is provided a method and device for automatically selecting a gloss finish for a print from an electrophotographic printing machine. The image characteristics and color content are determined and if the characteristics and content exceed a predetermined level, an auto gloss signal is generated by the machine controller. In one instance, a glossy substrate is selected upon which to print the image. In a second instance the fuser is adjusted so as to produce a glossy image output on the substrate. There is also a user selectable mode in which either all prints can be produced on a gloss substrate or on a matte substrate depending on the desired state.

11 Claims, 2 Drawing Sheets

AUTO-GLOSS SELECTION FEATURE FOR COLOR IMAGE OUTPUT TERMINALS (IOTS)

Figure 1:
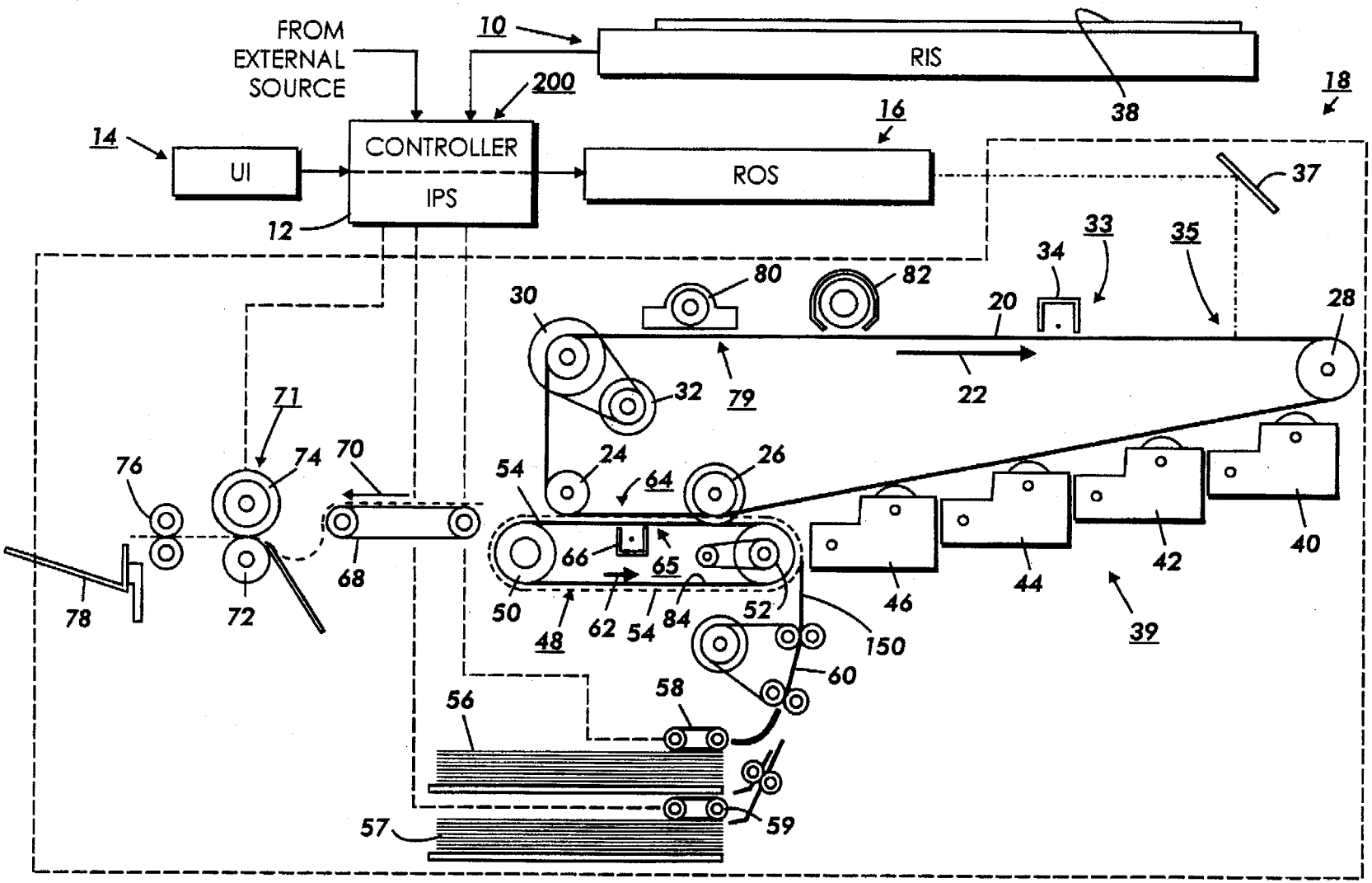

This invention relates generally to an automatic document quality option for an electrophotographic printing machine, and more particularly concerns an automatic parameter adjusting device to produce high quality color prints.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The above description describes generally a black and white printing machine. A color machine uses the same basic process to build up a multi layer multi color toner image to create full color prints. High quality pictorial images can be produced in this fashion. This type of image can be further enhanced with the use of a gloss finish. It has been determined that a large percentage of users prefer a gloss finish on full color prints to provide a photographic like finish.

It is desirable to have a feature set which allows the automated selection of a gloss finish in color electrophotographic printing machines. Based on evaluation of the input data stream, the page description language (PDL) or specific instructions from the user, certain pages in a document can be designated to be printed with a gloss finish while others are designated to be matte. This is achieved by selecting coated glossy paper from an auxiliary paper tray and/or selecting an alternative fusing process which is incorporated in the machine. The purpose of this is to provide a gloss finish for gloss pictorial images and a matte finish for text on an intermixed basis without user intervention.

The following disclosures may relate to various aspects of the present invention:

U.S. Pat. No. 5,127,643 Patentee: DeSanctis et al. Issued: Jul. 7, 1992

U.S. Pat. No. 4,937,592 Patentee: Akao, et al. Issued: Jun. 26, 1990.

U.S. Pat. No. 4,920,384 Patentee: Okamoto; Issued: Apr. 24, 1990

U.S. Pat. No. 4,609,283 Patentee: Murata, et al. Issued: Sept. 2, 1986.

U.S. Pat. No. 4,248,528 Patentee: Sahay Issued: Feb. 3, 1981

Some portions of the foregoing disclosures may be briefly summarized as follows:

U.S. Pat. No. 5,127,643 discloses An automatic copy paper selecting device that chooses the proper type of copy sheet based on the paper weight of the sheets of the original document without the necessity of utilizing coded control sheets or other operator input. A paper weight sensor in the document handler determines the weight of each original sheet and sends a signal to a programmable controller which then selects the proper copy sheet feed tray based on preprogrammed parameters.

U.S. Pat. No. 4,937,592 discloses a device which utilizes encoded control sheets which operate the machine and select desired functions so as to provide the copying qualities selected.

U.S. Pat. No. 4,920,384 describes a copying machine which utilizes various sensors in the document handling device to detect size variations in the original documents and adjust the magnification of the copying machine accordingly.

U.S. Pat. No. 4,609,283 describes a copying apparatus having a control panel that can be enabled for subjectively programming copying functions while displaying same to the user. The user can store a certain code or program in correlation to a specific code indicia. The code indicia can then be placed on a document and inserted into the copying machine where the code indicia will be sensed and the pre-recorded functions repeated.

U.S. Pat. No. 4,248,528 discloses a copier control system in which preprinted and operator marked control sheets otherwise corresponding to the regular original document sheets being copied are fed together with those regular documents past an optical scanner connected to the copier controller. The document sheets are copied in the manner instructed by the control sheets without requiring manual inputs.

In accordance with one aspect of the present invention there is provided an apparatus for producing high quality prints in a color electrophotographic printing machine. The apparatus comprises an image content determining device, to determine the characteristics and color content of an image to be printed and to generate a signal indicative thereof and a controller, responsive to the signal from the determining device, and to generate process control signals to adjust machine printing parameters as a function of the signal from the determining device.

Pursuant to another aspect of the present invention, there is provided a method for automatically creating enhanced high quality color prints in an electrophotographic printing machine. The method comprising determining the image characteristics and color content of an image to be printed and selecting enhanced printing parameters when the image characteristics and color content exceed predetermined threshold levels.

In accordance with yet another aspect of the present invention there is provided an apparatus for producing high quality prints in a color inkjet printing machine. The apparatus comprises an image content determining device, to determine the characteristics and color content of an image to be printed and to generate a signal indicative thereof and a controller, responsive to the signal from the determining device, and to generate process control signals to adjust machine printing parameters as a function of the signal from the determining device.

Figure 2:
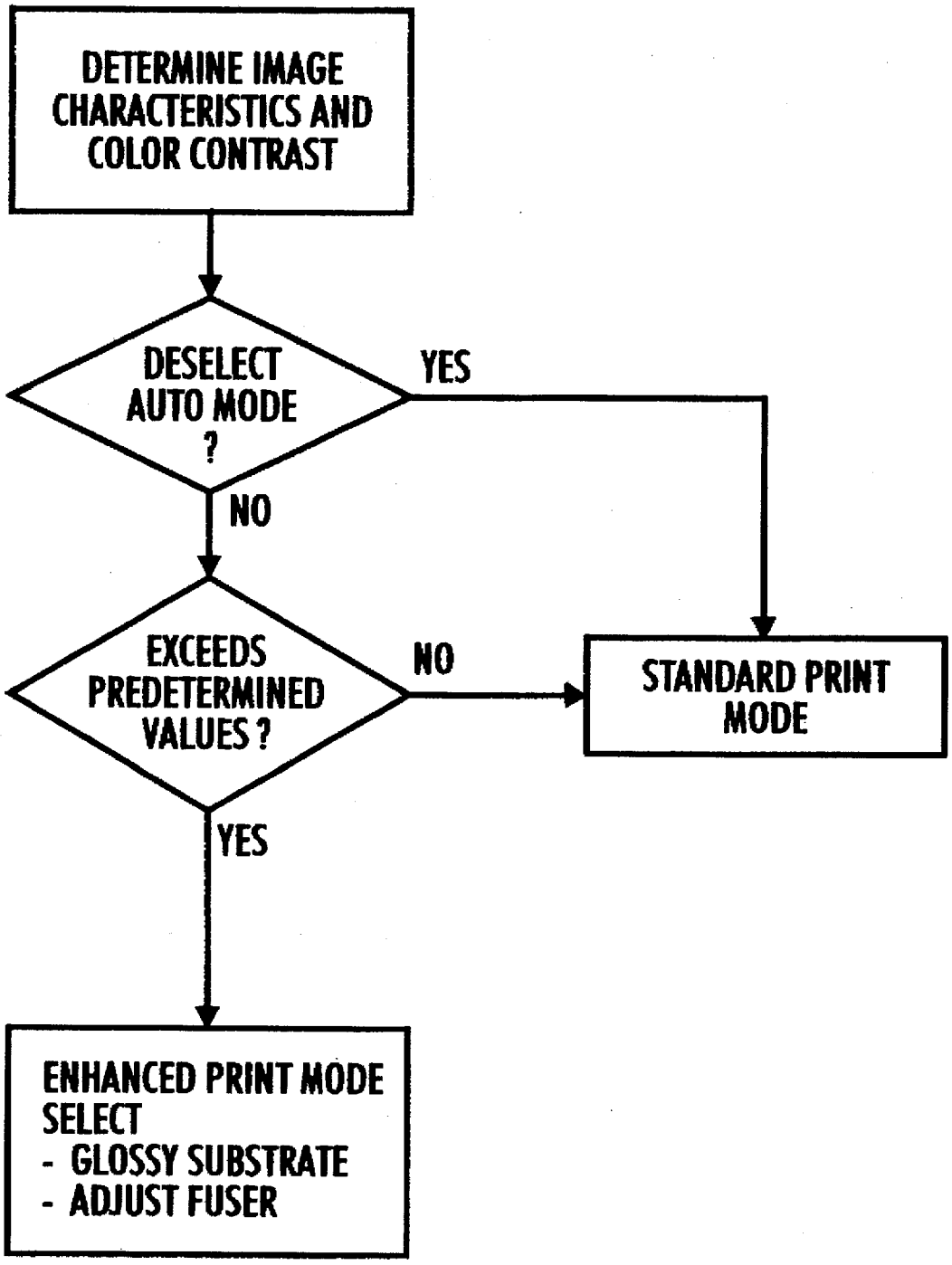

Other features of the present invention will become apparent as the following description proceeds and upon reference to the drawings, in which:

FIG. 1 is a schematic elevational view of a representative full color electrophotographic printing machine utilizing the invention herein; and FIG. 2 is a flow diagram illustrating the method of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like references have been used throughout to designate identical elements. FIG. 1 is a schematic elevational view of an illustrative electrophotographic machine incorporating the features of the present invention therein. The illustrated machine is of a multifunctional type which can serve as a digital copier, which can scan then print an original paper document, or it can function as a printer, receiving a digital page description file from a remote computer or workstation which can be decomposed into a set of printing instructions for the image output terminals (IOTs). It will become evident from the following discussion that the present invention is equally well suited for use in a wide variety of printing systems, and is not necessarily limited in its application to the particular system shown herein or even to an electrophotographic type of printing system.

Turning initially to FIG. 1, during operation of the system as a digital copier, a multi-color original document 38 is positioned on a raster input scanner (RIS) indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This representation is sometimes referred to as a bit-map. This information is transmitted to controller 200 which includes an image processing system (IPS), indicated generally by the reference numeral 12. IPS 12 contains control electronics which prepare and manage the image data flow to a raster output scanner (RQS), indicated generally by the reference numeral 16. A user interface (UI), indicated generally by the reference numeral 14, is in communication with IPS 12. UI 14 enables an operator to control the various operator adjustable functions, The output signal from UI 14 is transmiffed to IPS 12. In the case where the machine is being used as a printer, a data stream is received from the user which contains a representation of the desired image in the form of a PDL (page description language). This PDL representation contains all the pertinent details from which the image can be reconstructed.

A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. ROS 16 illuminates, via mirror 37, the charged portion of photoconductive belt 20. The ROS will expose the photoconductive belt to record three latent images. One latent image is developed with cyan developer material. Another latent image is developed with magenta developer material and the third latent image is developed with yellow developer material. The latent images formed by ROS 16 on the, photoconductive belt correspond to the signals transmitted from IPS 12. A fourth latent image can also be recorded to be developed with black toner.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document and or to provide undercolor removal in a color image. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. Based on the selection by the invention herein as described in further detail below, a sheet 150 is advanced from a stack of sheets 56, 57 disposed on one, of the paper supply trays. A friction retard feeder 58, 59 advances the uppermost sheet from stack 56, 57 onto a pre-transfer transport 60. Transport 60 advances sheet 150 to sheet transport 48. Sheet 150 is advanced by transport 60 in synchronism with the movement of sheet gripper 84. In this way, the leading edge of sheet 150 arrives at a preselected position, i.e. a loading zone, to be received by the open sheet gripper. The sheet gripper then closes, securing sheet 150 thereto for movement therewith in a recirculating path. The leading edge of sheet 150 is secured releasably by the sheet gripper. As belts 54 move in the direction of arrow (>2, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station, includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

As illustrated by the flow diagram of FIG. 2, this invention describes a number of features which deal with the issue of image gloss in xerographic IOT products which will include hybrid black/white, text and pictorial applications. The first feature is called "Auto-Substrate Selection" which should not be confused with the auto paper selection features described in the background materials which deal with paper sizes and reduction/enlargement issues. The two ideas are related in the sense that the auto paper select feature depends on the fact that the appropriately sized documents are available in the various feeder trays and the auto substrate also requires that the required substrates are available (in the appropriate size), but that is where the similarity ends. Just as the key enabler for auto size is the ability to detect the size of the originals, the key enabler for auto substrate lies in the detection of the requirement for gloss.

A second feature is "Auto-Gloss" which includes the "Auto-Substrate Select" feature but also affects the fusing device in order to produce a gloss image in the final copy.

In the simplest case, a customer might indicate gloss level as a property of a given document page. This information is communicated to the IOT controller through the ESS functionality and used to select the appropriate paper tray as well as the user setting. Thus, one aspect of the invention is the notion of a gloss property to be associated with a document. The adjustment of a fusing system to produce varying levels of gloss is not the subject of this invention, however, is well known in the electrophotographic printing art. The invention herein generates a signal to indicate that such a gloss adjustment for a fuser is desirable. In the printer mode, this designation would be embedded along with other page properties in the PDL header. In the digital copier mode, this could be indicated by means of the user interface. A second feature of the invention is to have a form of auto gloss detection or production incorporated into the printing system. This feature is based on the premise that if the original document was on glossy paper, then the copy would also be made on glossy paper. In the case of a copier, a sensor is used to detect the gloss level of the original image being copied. The sensor consists of a single light source and two detectors. The gloss angle of the surface can be determined by taking the ratio of the light detected by each of the two detectors with respect to their relative geometry. This gloss information can then be used to select the appropriate paper and/or fusing parameter to be applied to the copy of that particular original.

Another case, is the general IOT case which could relate to either a digital copier or a printer, in which the incoming image data stream is analyzed to determine whether a gloss or matte finish would be most suitable for that particular image. This determination is based on an algorithm which will incorporate the user input. For example, the algorithm can determine whether to use gloss for all color images, for all pictorial images or for pictorial color images only. The recognition of image types is done by a fairly simple image characterization algorithm. The response to the gloss input is the same as that described above.

In operation, this feature set would provide a means in the image processing system to intercept the bit-stream which contains the image representation and analyze it to see if it meets the criteria that would generate a request for a gloss paper selection. If the answer is yes, the corresponding target sheet for that image would be fed from an alternative paper supply which contains the glossy paper. The criteria upon which the gloss selection would be based upon a short list of parameters which would include image density (this would easily eliminate text), use of color, and the size of the region(s) in question. This last parameter deals with the case where a postage stamp sized image appears on the page which meets the other two criteria, and the user may not want gloss paper used in this case. Default values for these parameters can be provided, making the feature transparent to the user. Additionally some means can be provided to allow the user to specify his or her criteria for the selection of gloss paper. So for example, the user can specify a region or regions with a local average image density 2.5 times higher than that of normal 10 point text, the use of at least three colors and can further specify that this region or regions must constitute at least 20% of the total available image area, not including margins. This interface will most likely be provided through software which the user can address through his/her computer or workstation although it is also possible to provide this interface on the printer's control panel It is of course recognized that while the preferred embodiment has been illustrated being utilized in an electrophotographic printing machine, it is, also applicable to other printing environments such as inkjet, thermal transfer etc.. In each case, the user can deselect the feature and request all gloss or all matte finish for the entire print job.

In recapitulation, there is provided a method and device for automatically selecting a gloss finish for a print from an electrophotographic printing machine. The image characteristics and color content are determined and if the characteristics and content exceed a predetermined level, an auto gloss signal is generated by the machine controller. In one instance, a glossy substrate is selected upon which to print the image. In a second instance the fuser is adjusted so as to produce a glossy image output on the substrate. There is also a user selectable mode in which either all prints can be produced on a gloss substrate or on a matte substrate depending on the desired state.

It is, therefore, apparent that there has been provided in accordance with the present invention, a automatic substrate and image gloss selector that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for producing high quality prints in a color electrophotographic printing machine, comprising:

an image content determining device, to determine the characteristics and color content of an image to be printed and to generate a signal indicative thereof;

a controller, responsive to the signal from said determining device, to generate process control signals to adjust machine printing parameters as a function of the signal from said determining device, wherein said controller selects a high gloss substrate when the color content of a document exceeds a predetermined percentage, wherein the predetermined percentage is user adjustable.

2. An apparatus according to claim 1, wherein said controller further sends a signal to a fusing device so that a high gloss finish is created on the printed document when the color content of the document exceeds a predetermined percentage.

3. An apparatus according to claim 1, further comprising a user actuable deselect mode, wherein the high quality print mode is inoperable.

4. An apparatus according to claim 1, wherein said determining device is a raster input scanner in a digital copying machine.

5. An apparatus according to claim 1, wherein the printing machine is a digital printer.

6. A method for automatically creating enhanced high quality color prints in an electrophotographic printing machine comprising:

determining the image characteristics and color content of an image to be printed;

selecting enhanced printing parameters when the image characteristics and color content exceed predetermined threshold levels, wherein the predetermined threshold levels are user adjustable.

7. A method according to claim 6, wherein the selecting step comprises selecting a glossy substrate upon which to form an image when the image characteristics and color content exceed the predetermined threshold levels.

8. A method according to claim 8 wherein the selecting step comprises adjusting a fusing device to produce a high gloss toner image on a substrate when the image characteristics and color content exceed the predetermined threshold levels.

9. A method according to claim 6, further comprising deselecting the enhanced mode when high quality prints are not desired by a user.

10. An apparatus for producing high quality prints in a color inkjet printing machine, comprising:

an image content determining device, to determine the characteristics and color content of an image to be printed and to generate a signal indicative thereof;

a controller, responsive to the signal from said determining device, to generate process control signals to adjust machine printing parameters as a function of the signal from said determining device, wherein said controller selects a high gloss substrate when the color content of a document exceeds a predetermined percentage, wherein the predetermined percentage is user adjustable.

11. An apparatus according to claim 10, further comprising a user actuable deselect mode, wherein the high quality print mode is inoperable.

* * * * *